US007631432B2

(12) United States Patent
Roes

(10) Patent No.: US 7,631,432 B2
(45) Date of Patent: Dec. 15, 2009

(54) COMPACT MULTIFUNCTION SIGHT

(75) Inventor: John B. Roes, San Diego, CA (US)

(73) Assignee: Cubic Corporation, San Diego, CA (US)

( * ) Notice: Subject to any disclaimer, the term of this patent is extended or adjusted under 35 U.S.C. 154(b) by 176 days.

(21) Appl. No.: 11/954,538

(22) Filed: Dec. 12, 2007

(65) Prior Publication Data

US 2009/0064514 A1 Mar. 12, 2009

Related U.S. Application Data

(63) Continuation of application No. 11/370,590, filed on Mar. 7, 2006, now Pat. No. 7,325,318.

(60) Provisional application No. 60/719,926, filed on Sep. 22, 2005.

(51) Int. Cl.
*G01C 15/00* (2006.01)

(52) U.S. Cl. ..... 33/227; 33/286; 33/DIG. 21

(58) Field of Classification Search ..... 33/281–282, 33/285–286, 275 R, DIG. 21, 227, 228, 293; 250/338.1, 339.02, 339.11
See application file for complete search history.

(56) References Cited

U.S. PATENT DOCUMENTS

| | | | | |
|---|---|---|---|---|
| 5,272,514 | A | 12/1993 | Dor | |
| 5,577,326 | A | 11/1996 | Montelin | |
| 5,815,936 | A | 10/1998 | Sieczka et al. | |
| 6,345,464 | B1 | 2/2002 | Kim et al. | |
| 6,439,892 | B1 | 8/2002 | Gerber | |
| 6,490,060 | B1 | 12/2002 | Tai et al. | |
| 6,771,325 | B1 | 8/2004 | Dewald et al. | |
| 6,906,864 | B2 * | 6/2005 | Bergen | 33/227 |
| 7,181,855 | B2 | 2/2007 | Krantz et al. | |
| 2005/0018715 | A1 * | 1/2005 | Varshneya et al. | 372/6 |

(Continued)

FOREIGN PATENT DOCUMENTS

| | | | |
|---|---|---|---|
| WO | WO 2004/001324 | A1 | 12/2003 |
| WO | WO 2004/023059 | A1 | 3/2004 |

OTHER PUBLICATIONS

"*Night Vision Googles, Gen 3 AN/PVS-7D (F5001 Series)*," ITT Industries Engineered for life, 2004, ITT Industries, Inc., 2 pages.

(Continued)

*Primary Examiner*—Yaritza Guadalupe-McCall
(74) *Attorney, Agent, or Firm*—Townsend and Townsend and Crew

(57) ABSTRACT

A multifunction sight is disclosed. The multifunction sight includes an body, a receiving aperture, an emitting aperture, a parabolic reflector, and an optical detector. The receiving aperture passes radiation in a first band and a second band into the body where the first band is different from the second band. The emitting aperture that passes the radiation in the first band out of the body. The parabolic reflector displays a point source such that the point source is visible from the emitting aperture. The point source appears aligned with where the multifunction sight is aimed irrespective of a visual alignment with the emitting aperture. The optical detector is affixed to the body and coupled to the radiation in the second band, and receives coded radiation with the second band.

20 Claims, 7 Drawing Sheets

U.S. PATENT DOCUMENTS

| | | | | |
|---|---|---|---|---|
| 2005/0104794 | A1 | 5/2005 | Rao et al. | |
| 2005/0286895 | A1* | 12/2005 | Lee et al. | 398/79 |
| 2007/0165688 | A1* | 7/2007 | Lee et al. | 372/71 |

OTHER PUBLICATIONS

Aimpoint: Technology, "*The Future in Sight*," Aimpoint, 2005 Aimpoint AB, Sweden, www.aimpoint.com, 2 pages.

"*Frequently Asked Questions*," ITTNV: Camera Systems: FAQ, 2005 ITT Industries, www.ittnv.newcitymedia.com, 2 pages.

Aimpoint: Why Aimpoint Sights, "*The Future in Sight, Why Aimpoint Sights*" Aimpoint, 2005 Aimpoint AB, Sweden, www.aimpoint.com, 2 pages.

Red Dot Sight—Wikipedia, The Free Encyclopedia, "*Red dot sight*," www.en.wikipedia.org, 2 pages.

* cited by examiner

COMPACT MULTIFUNCTION SIGHT

CROSS-REFERENCES TO RELATED APPLICATIONS

The present application is a continuation of U.S. application Ser. No. 11/370,590, filed Mar. 7, 2006, which claims benefit of priority from U.S. Provisional Patent Application No. 60/719,926, filed Sep. 22, 2005, each of which is incorporated by reference for all purposes.

BACKGROUND

This disclosure relates in general to sighting scopes and, more specifically, but not by way of limitation, to sighting scopes that have functionality beyond mere aiming.

Military and law enforcement personnel use weapons in a variety of different operating environments. These operating environments may range from dry and dusty terrain, to moist and humid regions, to places with significant levels of precipitation. There is also a need to use weapons under many different lighting conditions. Reliable operation and the ability to withstand rugged treatment are concerns in these types of environments and lighting conditions. This is particularly true for weapon sights.

Over the years, red dot sighting systems have been used instead of mechanical iron sights. Red dot sights, in particular, have been commercially available for many years. These sights, which allow the operator to identify a target over a wide field of view and with unlimited eye relief, have been used with night vision equipment. A shooter wears a night vision monocular to view through the red dot sight at night, alternatively a 3× scope can be mounted in front of the red-dot scope.

Optical transmitters and receivers are used to communicate information wirelessly. For example, weapon targeting systems, laser-tag and military training systems may communicate with light beams between two points. These systems are bulky additions to other sighting equipment. On some weapon targeting systems, the user views a potential target through a first objective lens to communicate with a friendly target. A second objective lens is used to aim the weapon if the weapon targeting system identified that the target is a foe. These two objective lenses are bulky and add considerably to the overall weight of any weapon. This increased bulk, in turn, makes the weapon more difficult to use in combat and thus more dangerous for the user. Also, both the targeting and the communication optics need to be co-aligned with the weapon.

SUMMARY

In one embodiment, the present disclosure provides a multifunction sight. The multifunction sight includes a body, a receiving aperture, an emitting aperture, a parabolic reflector, and an optical detector. The receiving aperture passes radiation in a first band and a second band into the body where the first band is different from the second band. The emitting aperture passes the radiation in the first band out of the body. The parabolic reflector for creating an optical path to a point source or emitter such that the point source is visible from the emitting aperture. The point source marks a point that is aligned with where the weapon is aimed irrespective of a visual alignment with the emitting aperture. The optical detector is affixed to the body and coupled to the radiation in the second band, and receives coded radiation with the second band.

In another embodiment, the present disclosure provides a multifunction sight. The multifunction sight includes a body having a receiving end and an emitting end, a channel for guiding radiation in a first band and a second band through the body, a parabolic reflector positioned within the channel, an emitting aperture, a light-bending mechanism, and an optical detector. The emitting aperture passes radiation in the first band out of the body. The parabolic reflector displays the point source such that it is visible from the emitting aperture. The point source appears aligned with where the weapon is aimed irrespective of a visual alignment with the emitting aperture. The light-bending mechanism diverts radiation in the second band from the channel to a detecting location. The optical detector is coupled to receive radiation in the second band at the detecting location.

In yet another embodiment, a method for providing targeting optical information is disclosed. Radiation is received through a receiving aperture. A point source is superimposed upon the received radiation, where the point source corresponds to where the receiving aperture is aimed irrespective of a position of a user. The received radiation is separated by wavelength into a first band and a second band, where the first band and the second band are different. The first band is passed outside the body through an emitting aperture. The second band is directed to an optical receiver. Coded information is extracted from the second band.

Further areas of applicability of the present invention will become apparent from the detailed description provided hereinafter. It should be understood that the detailed description and specific examples, while indicating various embodiments of the invention, are intended for purposes of illustration only and are not intended to necessarily limit the scope of the invention.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure.

Figure 1:
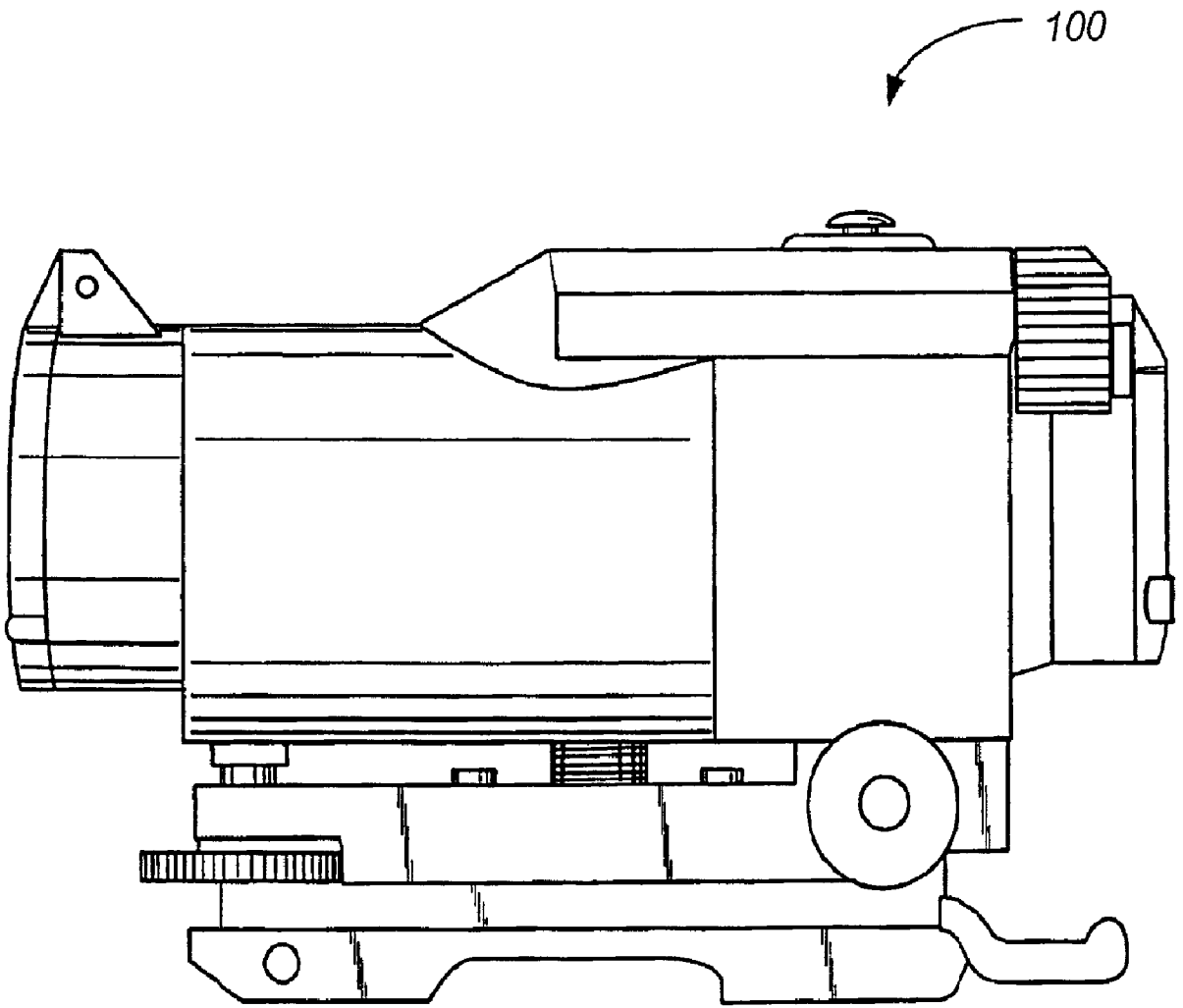
FIG. 1 illustrates an embodiment of a weapon sighting system adapted for use with a rifle or handgun.

Initially referring to FIG. 1, an embodiment of a weapon sighting system 100 adapted for use with a rifle or handgun is shown in profile. This embodiment exemplifies a compact design which is lightweight, rugged, and capable of performing multiple functions. The weapon sighting system 100 has a weapon mount that can be adjusted for calibration. Attachments allow magnification and/or night vision functionality to be added to the weapon sighting system 100. In another embodiment, a magnification or night vision unit is attached to the eyepiece. This embodiment has integral lens caps to protect the receiving and emitting apertures.

Figure 2:
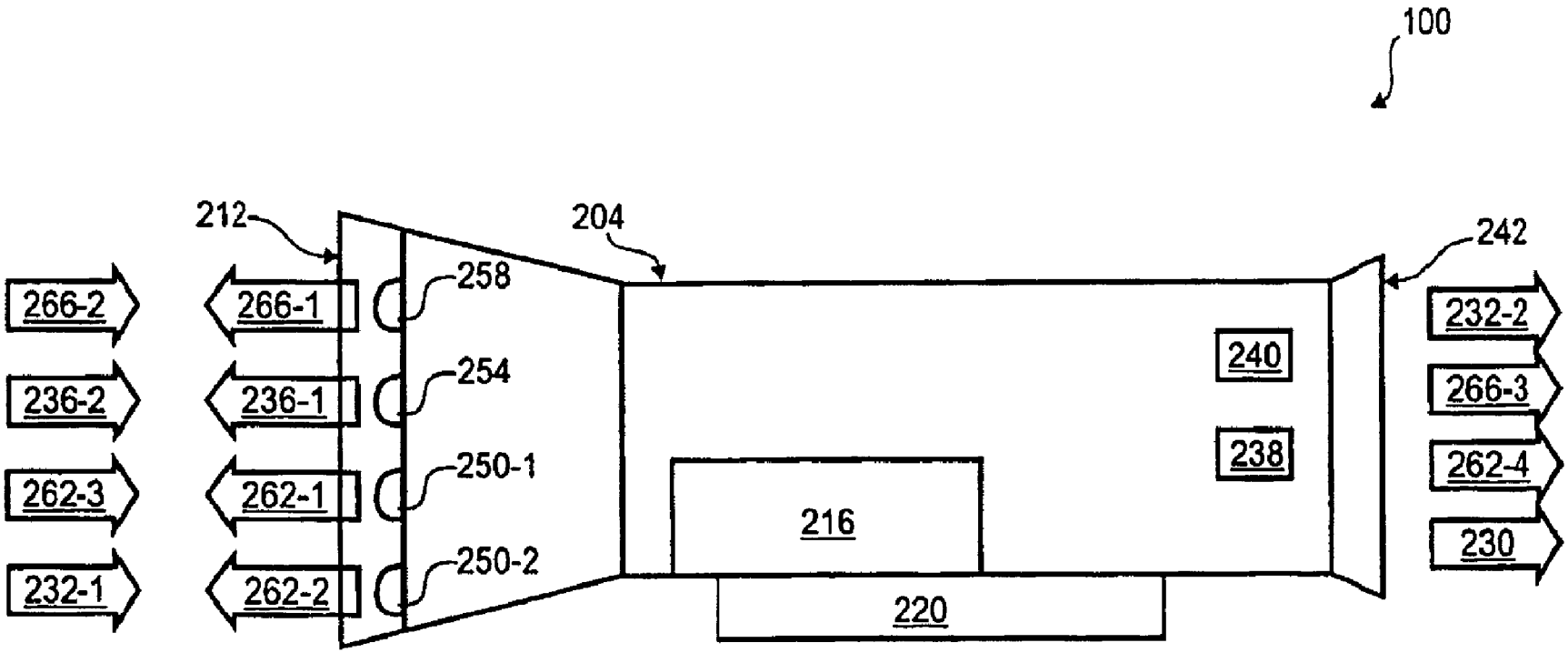
FIG. 2 is a side view of an embodiment of a weapon sighting system that supports multiple functions.

Referring next to FIG. 2, a diagram of an embodiment of a weapon sighting system 100 is shown. As depicted, the weapon sighting system 100 may be used with a rifle or handgun. However, other embodiments may be used with vehicle-mounted weapons, aerial weapons, or artillery pieces or other targeting systems.

The weapon sighting system 100 facilitates directing or aiming a weapon system toward a target. Additionally, this embodiment of the weapon sighting system 100 permits target identification in many different operating conditions. For example, the weapon sighting system 100 permits a target to be identified at night or during the day and can be used in combat or training situations. An operator uses the weapon sighting system 100 to aim a weapon or other device directly at a target and can optionally use magnification and/or image amplification. This embodiment uses red dot optics to allow aiming the weapon sighting system irrespective of the operator's orientation with an eyepiece.

The weapon sighting system 100 further provides target identification of a potential target as friend or foe. When directed toward an unknown object, an embodiment of the weapon sighting system 100 provides cues to the user to signify that the object has been identified as friendly. For example, in some embodiments, the weapon sighting system 100 may alert the operator when a potential target has been identified as friendly. In other embodiments, the weapon sighting system 100 may generate a variety of audible and/or visual signals to inform the user that the target has been identified as friendly or could event lock down the firing mechanism in other embodiment. Under battlefield conditions, for example, this functionality may help to reduce incidents of "fratricide" or "friendly fire" by providing a means for discriminating among potential targets.

In a gun-mounted embodiment, targets may be identified and interrogated over a range of 25 to 1,000 meters with optional three times optical magnification. Other embodiments could have different effective ranges and optical magnification. The weight of the weapon sighting system 100 is less than 550 grams in one embodiment and has dimensions of a 145 mm length by 60 mm width by 82 mm height, or less. Other weights and sizes are possible for other embodiments.

The weapon sighting system 100 receives radiation from the environment through a receiving aperture 212. This radiation may arise naturally or from man-made sources. In both cases, the radiation is typically a spectrum of wavelengths including many different wavelengths of interest. To facilitate explanation, FIG. 2 separately identifies four bands 232-1, 266-2, 262-3, 236-2 of radiation even though many others pass through the receiving aperture 212 from the environment. Each band could be a single range of wavelengths or a number of ranges.

The receiving aperture 212 passes radiation in a first wavelength band 232-1 which is generally visible to the human eye during daylight conditions. This first wavelength band 232-1 may include radiation with wavelengths in the range of about 350 nm to about 750 nm. A second band of radiation 266-2 is also passed by the receiving aperture 212 and in this embodiment includes highly collimated light such as a laser beam. In an exemplary embodiment, radiation in the second band 266-2 is a green laser beam. The receiving aperture 212 passes two additional wavelength bands 236, 262 that are not normally visible to the unaided human eye. For example, radiation in a third band 262 may include a portion of the infrared spectrum with wavelengths in the range of about 800 nm to about 1000 nm. The range of wavelengths in the third band 262 coincides with those wavelengths used by night vision receivers. Radiation in a fourth band 236 may include wavelengths of approximately 1.55 microns that may carry encoded information in one embodiment.

The weapon sighting system 100 also includes one or more radiation emitters 250, 254, 258 in various embodiments. Two infrared emitters 250 are used in this embodiment to optionally augment environmental radiation in the third band 262. The infrared emitters 250 produces radiation at predetermined wavelengths that are not generally visible to the human eye. In one embodiment, there are two infrared emitters 250-1, 250-2 that emit radiation 262-1, 262-2 with different degrees of collimation within the third band 262. For example, one infrared emitter 250-1 could be highly collimated (i.e., a laser) to indicate where the weapon is aimed and the other infrared emitter 250-2 could be less collimated (i.e., a LED) to illuminate the general area visible through the weapon sighting system 100.

The wavelengths of the two infrared emitters could be the same or different. This radiation band 262-1, 262-2 is emitted into the environment in the direction of the target for reflection back toward the receiving aperture 212 in low- or no-light conditions. The infrared emitters 250 are controllable and can be activated, deactivated, or adjusted by the operator at the same time or separately controlled. In one embodiment, one of the infrared emitters 250 has a 50 mW output.

Another optical transmitter 254 emits radiation in the fourth band 236-1 toward a target. This radiation 236-1 includes pulses that encode information sent from the weapon sighting system 100 to a remote point of contact. For example, the optical transmitter 254 may emitting coded pulses in the fourth band that serve to identify the weapon sighting system 100 to others, communicate information or speech, etc. In this way, for example, the weapon sighting system 100 can identify others as friend or foe.

An alignment laser 258 is included to facilitate aligning the weapon sighting system 100 with the point at which the weapon fires. The alignment laser 258 emits a highly collimated beam of visible light 266-1 that is reflected back to the receiving aperture 212. The reflected radiation 266-2 indicates the current aim point of the weapon sighting system 100. In this embodiment, an adjustment screw of the mount is provided for adjusting the aim point of the weapon sighting system 100 relative to its mount point on the weapon. By firing the weapon and noting the point of impact in relation to the reflected radiation 266-2, the weapon sighting system 100 can be adjusted so that the reflected radiation 266-2 coincides with the point at which the weapon fires. The alignment laser 258 also permits the utilization of more sophisticated alignment techniques such as laser projectors which fit within the barrel of the weapon. Adjustment of the alignment laser 258 with respect to the laser projector allows calibrating the sighting system 100 to the weapon.

A point source is included with the weapon sighting system 100 to indicate the current aim point of the weapon under normal operating conditions. Some embodiments use a red dot sight that superimposes a point source or mark upon the scene radiation after it passes through the receiving aperture 212 but before it exits the emitting aperture, eyepiece or ocular 242. The radiation 230 of the point source 308 appears at an infinite distance within the field of view presented by the visible radiation 232-2 and is aligned with the aim point of the weapon sighting system 100. Because of the position of the point source radiation 230 coincides with the aim point of the weapon, a user can easily identify targets by viewing the point source radiation 230 from many different positions relative to the emitting aperture 242. In other words, the parabolic reflector 412 causes the point source radiation 230 to appear in the same location of the target view irrespective of head movement by the operator. Typically, the point source radiation 230 is a red dot, but could be other colors and could be shaped in various embodiments. The red dot point source emits to the parabolic wavelength selective surface of the first lens which sends a collimated red beam out of the ocular. To the observer, a red dot is visible over a wide aperture and the red dot overlays parallel with the weapon onto the scene visible through the ocular.

In addition, the intensity of the point source can be adjusted with a switch 240 attached to the body 204 to match environmental conditions. For example, the point source radiation 230 intensity could be reduced when operating the sighting system 100 with night vision equipment.

The body 204 includes an emitting aperture 242. The emitting aperture 242 allows radiation in various bands 232-2, 266-3, 262-4, 230 to largely pass out of the body 204. When used in daylight conditions, for example, a user might look into the emitting aperture 242 to see the visible radiation in the first band 232-2 with the superimposed point source radiation 230. In this way, potential targets can be identified and interrogated. Similarly, the user might choose to activate the alignment laser 258 and perform the calibration procedure using the reflected radiation 266-3 (i.e., the green laser in this embodiment) from the emitting aperture 242 and make necessary adjustments. Finally, a user might choose a night vision mode of operation for the sighting system 100. In this case, the weapon sighting system would direct radiation in the infrared spectrum 262-4 through the emitting aperture 242. A night vision receiver (not shown) could be mounted to the body 204 or the operator's face and used to direct the weapon towards a target in low-light conditions.

A mounting mechanism 220 is included to facilitate attachment of the weapon sighting system 100 to a weapon. The mounting mechanism 220 joins the body 204 securely to the weapon in an orientation so that the receiving aperture 212 faces the direction of potential targets. The mounting mechanism 220 may consist of screws, clamps, hinges, and other fasteners capable of holding the enclosure firmly in place while allowing it be removed from the weapon and reattached as needed. In one embodiment, the mounting mechanism 220 mounts to a Picatinny or Weaver gun rail. As mentioned above, the mounting mechanism 220 could be adjustable when calibrating the aim of the sighting system 100 to the weapon trajectory. A power supply or battery pack 216 is attached or integral to the body 204. The battery pack 216 is coupled to each of the electrical components included in the weapon sighting system. The battery pack 216 includes one or more batteries that are replaceable by the user in the field or by a repair technician. In one embodiment, the batteries are capable of providing power sufficient for more than 3,000 uses.

The body 204 may be made of metal or a rigid polymer material. In this embodiment, the body defines an interior through which radiation 232, 266, 236, 262 passes and is transformed into targeting information. The interior may be divided into one or more regions and may be accessible to the user or a repair technician. Together with each of the components in the weapon sighting system 100, the body 204 may form a closed container that limits access to the interior. In other embodiments, the body 204 may not form a completely closed container such that some components are exposed.

A mode selection switch 238 allows selection, activation and deactivation of several modes of operation for the sighting system 100. For example, an operator may choose the calibration mode that activates the alignment laser 258 while deactivating the other emitters 250, 254. Other modes include night vision illumination mode with or without the point source, daylight operation with and without the point source, target identification mode, war game mode, etc. In this embodiment, the selection switch is a rotating radio dial, but could have other configurations in other embodiments.

Figure 3:
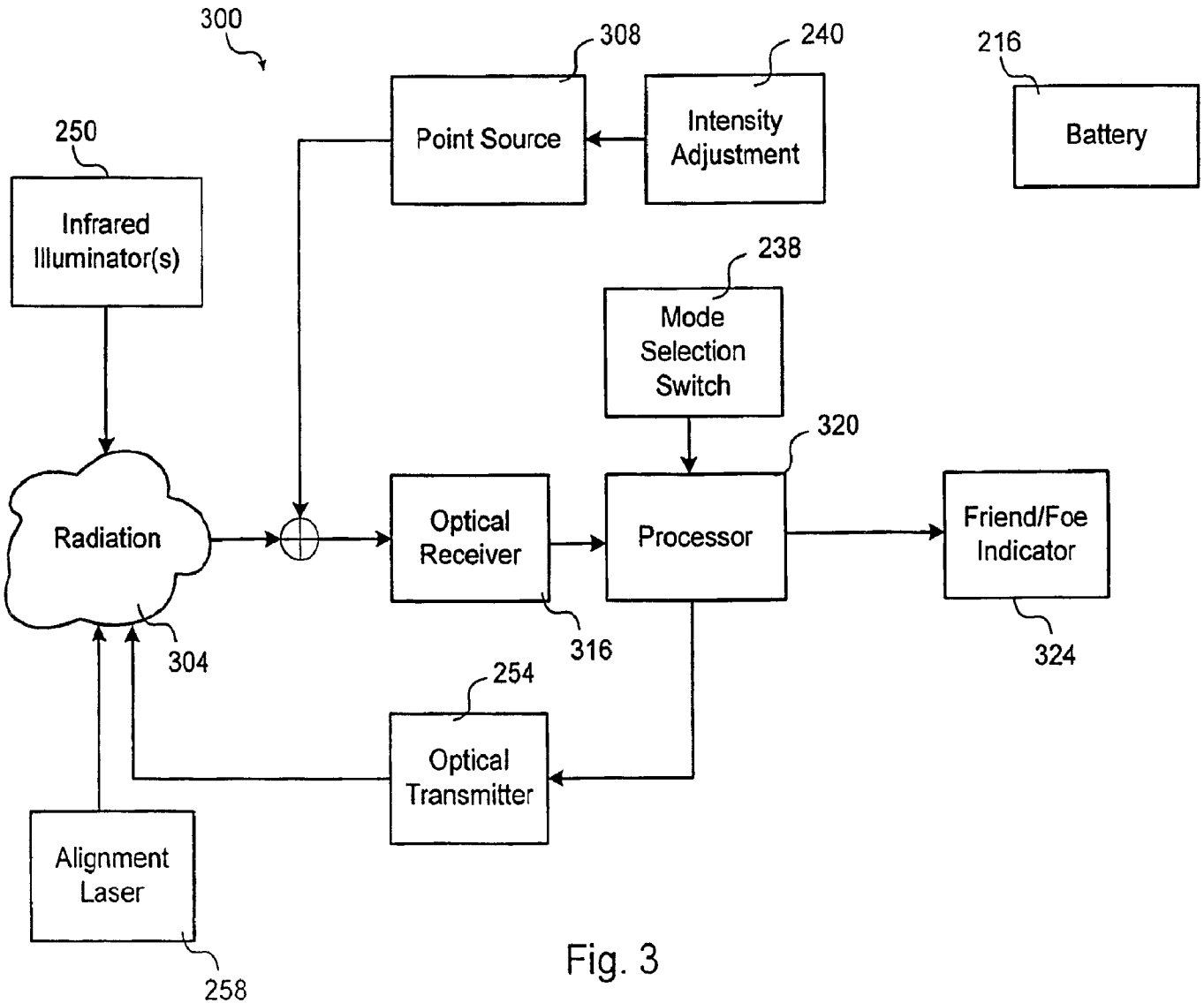
FIG. 3 is a block diagram of an embodiment of a weapon sighting system.

With reference to FIG. 3, a block diagram of an embodiment of the weapon sighting system 300 is shown. Radiation 304, visible or not visible, is coupled to the weapon sighting system 300 and utilized for aiming, calibration, target identification and interrogation. The radiation 304 may be ambient or augmented with various illuminators 250, 254, 258. For example, the radiation 304 may include wavelengths of approximately 1.55 microns in a fourth band 236 that carry pulse coded information.

A point source 308 is included to provide the red dot sight feature. In some embodiments, the point source 308 is fully contained within the body 204, while in others it may be accessible from outside the body 204. In still other embodiments, the point source 308 may detach from the body 204 to facilitate repair or replacement. A laser diode or LED could be used to generate the light for the point source 308. The intensity adjustment switch 240 allows the operator to adjust the brightness of the point source 308. In one embodiment, the point source 308 automatically reduces its intensity when the ambient light is detected to be low or when the night-vision is active. In this embodiment, the point source 308 emits radiation at a red visible wavelength, but other embodiments could use other wavelengths.

The point source 308 superimposes a dot, mark, crosshair, scale or other indicator to provide a virtual image at an infinite distance in substantial linear alignment with the weapon. In one embodiment, the mark is red, but other embodiments could use other visible colors. This mark facilitates targeting by a human or machine operator when aiming an associated weapon.

An optical receiver 316 is coupled to the radiation 304 that enters the body 204 in the fourth band 236-2. Radiation with a wavelength of approximately 1.55 microns is directed to the optical receiver 316 by elements of the weapon sighting system while other radiation 304 is allowed to pass largely unaltered. The optical receiver 316 extracts coded information from the radiation 236-2 and forwards it to the processor 320 for use within the weapon sighting system 300. In this embodiment the radiation in the fourth band 236-2 is encoded to represent a response to a request for identification, and/or the radiation in the fourth band 236-2 may represent data or voice communications. In this embodiment, the optical receiver 316 receives information pulse coded in the fourth band 236-2, but other embodiments could use other encoding techniques.

The processor 320 is coupled to receive signals from the optical receiver 316 and act upon them according to the position of the mode selection switch 238. When the weapon sighting system 300 is directed toward a potential target, the processor 320 might interrogate the target by directing the optical transmitter 254 to emit pulse coded radiation with a predetermined identification pattern. Additionally, the processor 320 receives a response to a previous request for identification and determines whether the potential target is a friend or foe, for example. This determination would then be communicated to a friend/foe indicator 324. The friend/foe indicator 324 might alert the user by flashing lights, dimming or preventing transmission of the optical transmission in the first band 232, changing the intensity or contrast of a night vision receiver, generating an audible signal, and/or locking down the weapon firing system.

In one embodiment, the weapon sighting system 300 uses 1.55 micron radiation for the fourth band 236 to exchange data or voice communications and target acquisition. By changing the position of the mode selection switch 238, the processor 320 directs the optical transmitter 254 to generate coded pulses of 1.55 micron radiation that carries the desired information to remote points of contact.

Figure 4A:
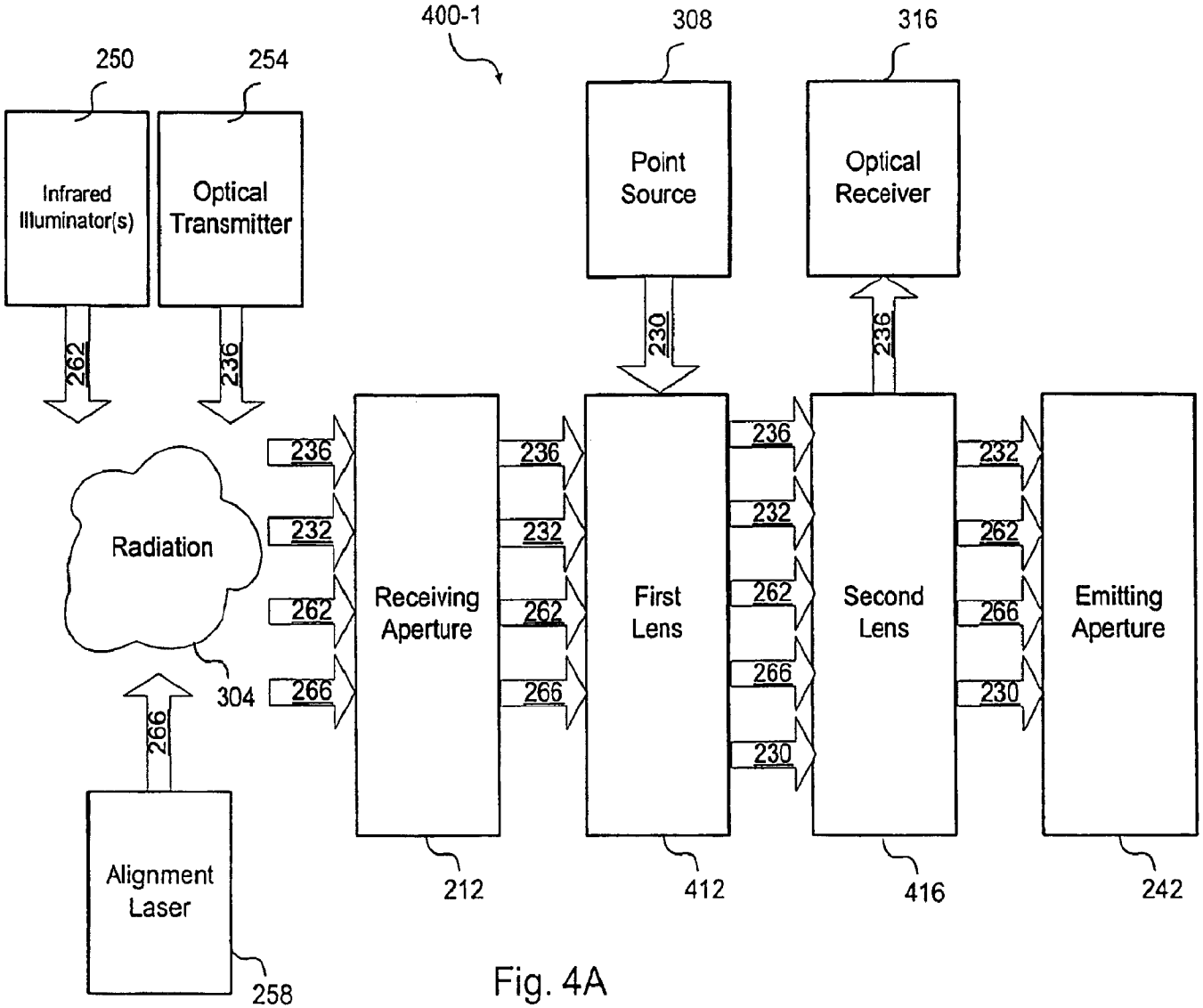
FIGS. 4A, 4B and 4C are optical flow diagrams of embodiments of a weapon sighting system.

Referring to FIG. 4A, a flow diagram of an embodiment of optical blocks 400-1 in the weapon sighting system 400-1 is shown. This figure shows how the various wavelengths of radiation interact with components of the weapon sighting system 400-1. The ambient and man-made radiation 304 includes at least four bands in this embodiment. Generally, the first band 232 includes visible light, the second band 266 includes a highly collimated beam of visible light such as a green laser beam, the third band 262 includes IR radiation from two emitters 250, and the fourth band 236 includes pulse coded radiation with wavelengths of approximately 1.55 microns.

The receiving aperture 212 accepts at least the radiation 304 in the four bands 232, 266, 236, 262 but may accept many more wavelengths. The radiation 304 from the receiving aperture 212 is coupled to a first lens 412 and a second lens 416 that split out and/or combine various radiation bands. The two lenses 412, 416 pass the first band of visible light 232 largely unmodified to the emitting aperture 242. Radiation in the second band 266 which may consist of a green (or other color) alignment laser also passes through the first and second lenses 412, 416 largely unmodified.

The first lens 412 has a wavelength-selective parabolic mirror that reflects the point source radiation 230 in a way that produces the red dot illusion for the user viewing through the eyepiece 242. The first lens 412 is a double lens encapsulating a wavelength-selective mirror that is shaped to receive the point source radiation 230 from outside the optical path and display it properly. The first lens 412 passes at least the first, second, third, and fourth bands 236, 266, 232, 262. Specifically, at least some visible light, green light, night vision infrared, and 1.55 micron infrared radiation is passed by the first lens 412, while radiation from the point source radiation 230 is reflected. The wave-length selective mirror reflects the wavelength of the point source 308 while passing the first through fourth bands 236, 266, 232, 262.

The second double lens 416 also encapsulates a wavelength-selective mirror and is contoured. The mirror of the second lens 416 passes at least the first band 232, the second band 266, the third band 262, the point source radiation 230 out the emitting aperture 242, and other wavelengths. But, the second lens 416 reflects the fourth band 236 to the optical receiver 316. Specifically, the second lens 416 reflects from 1.52 through 1.56 microns in this embodiment. Commercially-available coatings are available to provide the wavelength-selective reflection while passing other wavelengths.

Figure 4B:
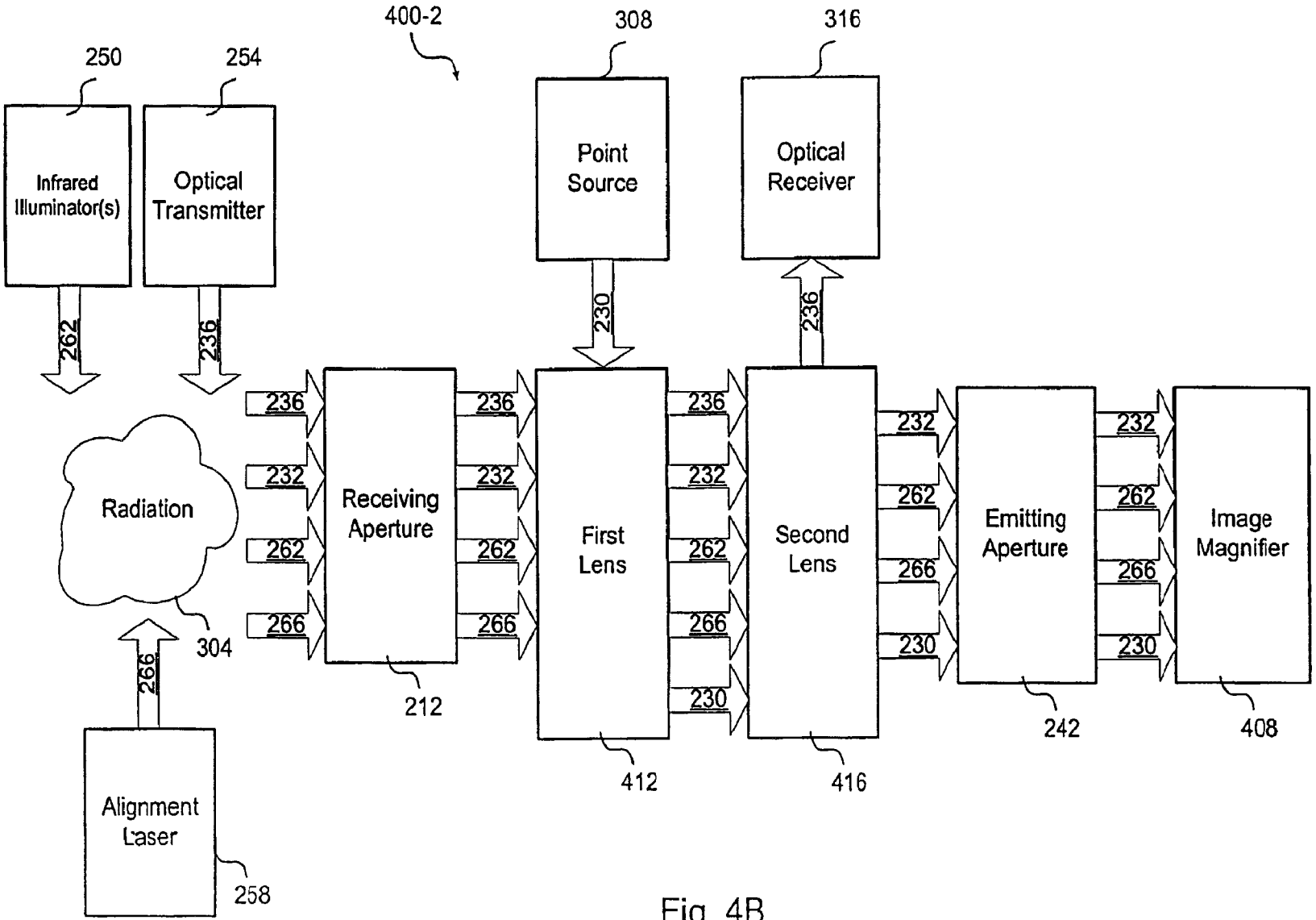

With reference to FIG. 4B, another embodiment of the weapon sighting system 400-2 is shown that includes an image magnification element 408. The image magnifier 408 enlarges the image to increase its size. The enlargement could be fixed at three times in one embodiment or some other magnification in other embodiments. In some embodiments, the amount of zoom could be adjustable. The image magnifier 408 and/or other optics could incorporate anti-shake correction to stabilize the image in some embodiments. Various embodiments could put the magnification element 408 anywhere in the optical path. In this embodiment, the magnification element 408 can be attached to the eyepiece 242.

Figure 4C:
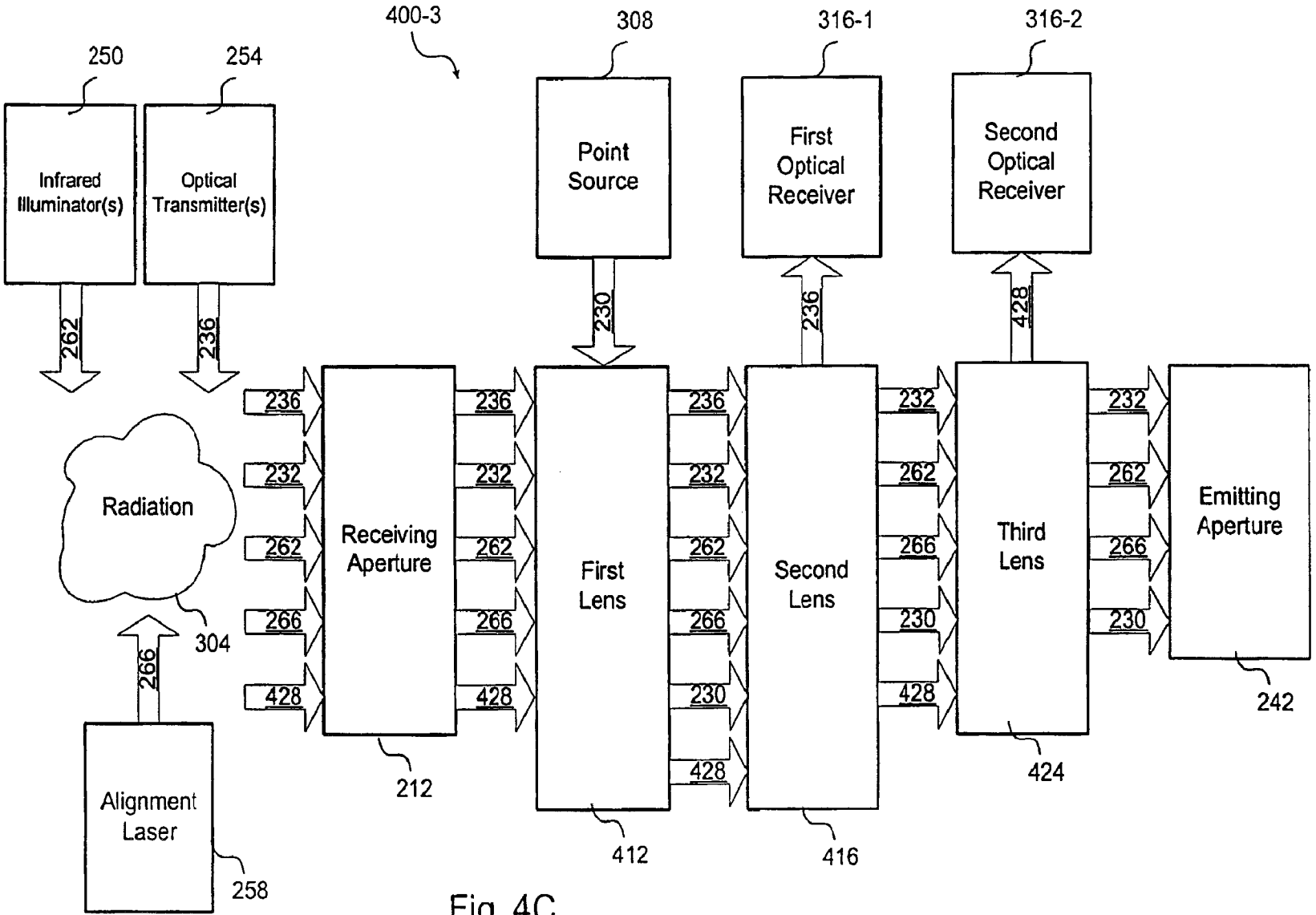

Referring next to FIG. 4C, yet another embodiment of the weapon sighting system 400-3 is shown with a second optical receiver 316-2 coupled to a third lens 424. In this arrangement, a fifth band of radiation 428 enters the receiving aperture 212 and is passed along by the first lens 412 and the second lens 416. The third lens 424 is contoured and has a wavelength-selective mirror that reflects radiation in the fifth band 428. Radiation in the fifth band 428 is reflected by the third lens to the second optical receiver 316-2 while radiation in the other bands is passed along to the emitting aperture 242. The third lens 424 may or may not collimate the radiation as it is reflected depending upon the particular application. For example, radiation in the fifth band 428 might be uncollimated and used as an input to a night vision receiver or collimated and used in connection as for data transport in training exercises. The wavelength of the fifth band 428 includes 0.905 micron radiation in one embodiment.

Figure 5:
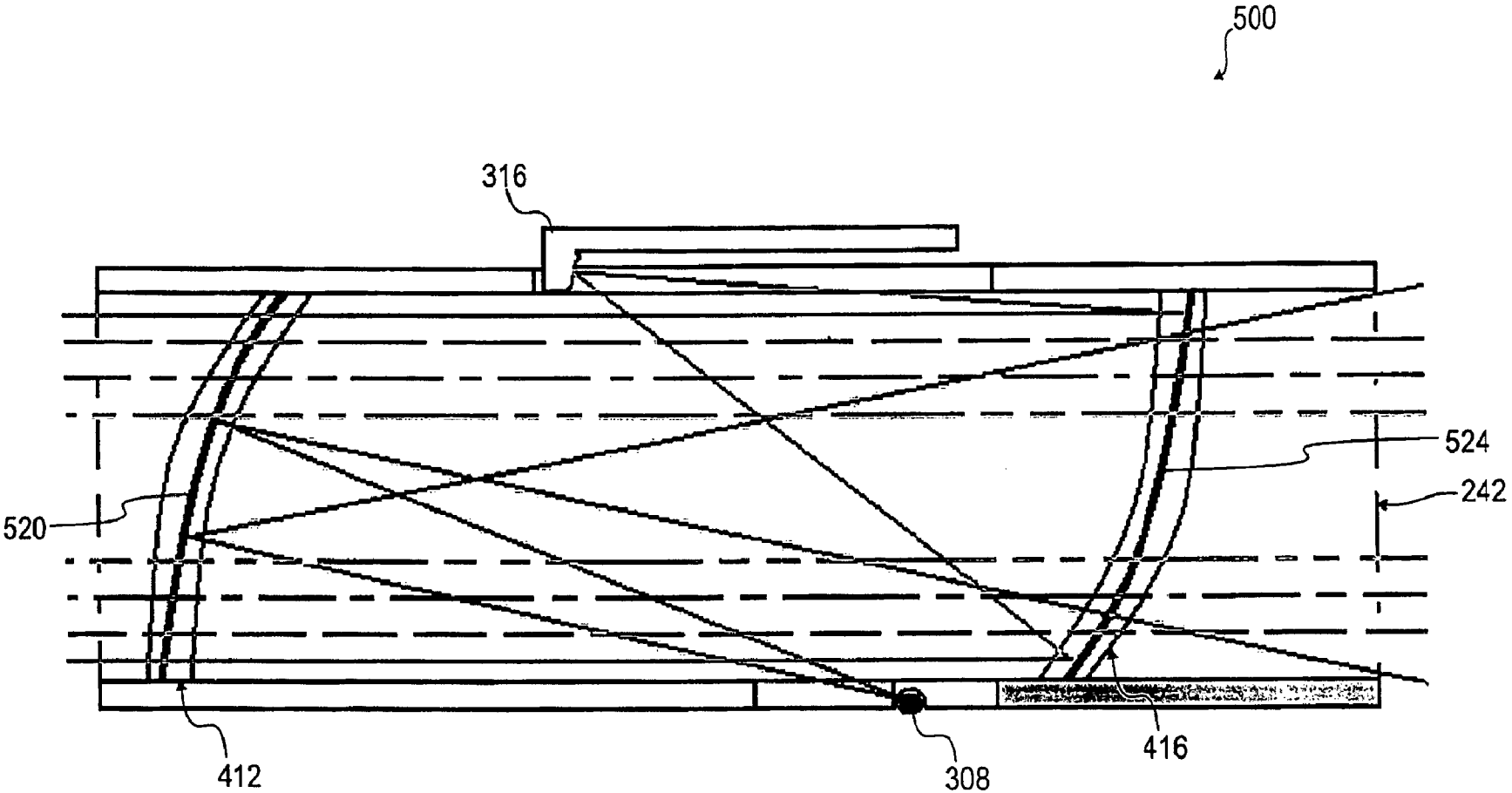
FIG. 5 is an optical diagram of an embodiment of weapon sighting optics.

With reference to FIG. 5, an optical diagram of an embodiment of weapon sighting optics 500 is shown. This diagram shows the first lens 412, the second lens 416, the emitting aperture 242, the point source 308, the optical receiver 316, among other things. The view through the weapon sighting optics 500 can be adjusted with an adjustment screw (not shown) that moves the entire weapon sighting optics 500 along with some or all emitters 250, 254, 258.

The first lens 412 has a first reflective coating 520 that reflects the point source radiation 230. The reflective coating 520 could extend the whole length of the first lens 412 or just a portion of the length. The second reflective coating 524 in the second lens 416 reflects 1.55 micron radiation 236 into the optical receiver 316. The coatings 520, 524 are inside the lenses 412, 416 in this embodiment. In one embodiment, the focal length of the first lens 412 is 60 mm, and the focal length of the second lens 416 is 40 mm. The aperture of both the first and second lenses 412, 416 in this embodiment is 29 mm. Other embodiments could have different focal lengths and sizes.

In this embodiment, the weapon sighting optics 500 are aligned with the weapon by moving the body 204 of the weapon sight relative to the weapon. For example, the elevation of the weapon sighting system 100 might be changed relative to the weapon by adjustments accomplished at the mounting rails with an adjustment screw(s) and/or a biasing spring(s). Other embodiments might only move lenses, the optical chamber or another subset of the weapon sighting system to adjust alignment.

While the principles of the disclosure have been described above in connection with specific apparatuses and methods, it is to be clearly understood that this description is made only by way of example and not as limitation on the scope of the invention.

What is claimed is:

1. A method for providing optical information, comprising:

receiving radiation through a receiving aperture;

superimposing a point source upon the received radiation, wherein the point source corresponds to where the receiving aperture is aimed irrespective of a position of a user;

separating the received radiation by wavelength into a first band and a second band wherein the first band and the second band are different;

passing the first band through an emitting aperture;

directing the second band to an optical receiver; and extracting coded information from the second band.

2. The method of providing optical information as recited in claim 1, wherein the step of receiving radiation is performed with a single objective lens.

3. The method of providing optical information as recited in claim 1, further comprising a step of transmitting encoded information in the second band away from the receiving aperture.

4. The method of providing optical information as recited in claim 1, further comprising a step of emitting radiation in a third band used by night vision systems.

5. The method of providing optical information as recited in claim 1, further comprising a step of magnifying the received radiation.

6. The method of providing optical information as recited in claim 1, wherein:

the step of separating the received radiation is performed by a plurality of lenses;

one of the plurality of lenses comprises a wavelength selective coating corresponding to one of the first and second bands.

7. The method of providing optical information as recited in claim 1, further comprising the steps of:

separating the received radiation into a first band, a second band, and a third band; and directing radiation in the third band to a second optical receiver.

8. The method of providing optical information as recited in claim 1, wherein the intensity of the point source can be varied.

9. A machine adapted to perform the machine-implementable method for providing optical information of claim 1.

10. A method of acquiring target information, comprising:

receiving radiation through a receiving aperture;

superimposing a point source upon the received radiation, wherein the point source corresponds to where the receiving aperture is aimed irrespective of a position of a user;

directing first wavelengths of the received radiation through an emitting aperture;

directing second wavelengths of the received radiation to an optical receiver;

extracting coded information from the second wavelengths; and determining a status of a target object based upon the coded information.

11. The method of acquiring target information of claim 10, further comprising providing a visual cue indicative of the status of the target object.

12. The method of acquiring target information of claim 11, wherein the visual cue indicates that the target object is a friend or a foe.

13. The method of acquiring target information of claim 10, further comprising transmitting coded information in the second band away from the receiving aperture.

14. The method of acquiring target information of claim 13, wherein the second band includes wavelengths of approximately 1.55 microns.

15. The method of acquiring target information of claim 13, wherein the coded information transmitted represents a request for identification of the target object.

16. The method of acquiring target information of claim 13, wherein the coded information transmitted comprises voice or data communications.

17. The method of acquiring target information of claim 10, further comprising separating the received radiation into the first wavelengths and the second wavelengths.

18. The method of acquiring target information of claim 17, wherein separating the received radiation is performed by a plurality of lenses, and at least one of the plurality of lenses comprises a wavelength selective coating corresponding to one of the first and second bands.

19. The method of acquiring target information of claim 10, further comprising emitting radiation in a third band used by night vision systems.

20. The method of acquiring target information of claim 10, further comprising emitting an alignment laser, and wherein the position of the point source is established using the alignment laser.

* * * * *